US007656082B2

(12) United States Patent
Ishimoto et al.

(10) Patent No.: US 7,656,082 B2
(45) Date of Patent: Feb. 2, 2010

(54) COLOR DISPLAY DEVICE

(75) Inventors: Manabu Ishimoto, Kobe (JP); Hitoshi Hirakawa, Kobe (JP); Kenji Awamoto, Kobe (JP); Hitoshi Yamada, Kawasaki (JP); Akira Tokai, Kawasaki (JP)

(73) Assignee: Shinoda Plasma Co., Ltd., Kobe (JP)

( * ) Notice: Subject to any disclaimer, the term of this patent is extended or adjusted under 35 U.S.C. 154(b) by 300 days.

(21) Appl. No.: 11/902,488

(22) Filed: Sep. 21, 2007

(65) Prior Publication Data

US 2008/0079346 A1 Apr. 3, 2008

Related U.S. Application Data

(63) Continuation of application No. PCT/JP2005/005348, filed on Mar. 24, 2005.

(51) Int. Cl.
*H01J 1/62* (2006.01)

(52) U.S. Cl. ..... 313/485; 313/487; 313/582

(58) Field of Classification Search ..... 313/582–587, 313/485–487; 315/169.1, 169.3; 345/60
See application file for complete search history.

(56) References Cited

U.S. PATENT DOCUMENTS

| | | | | |
|---|---|---|---|---|
| 2003/0048068 | A1* | 3/2003 | Yamada et al. | 313/485 |
| 2004/0108813 | A1* | 6/2004 | Tokai et al. | 313/582 |

FOREIGN PATENT DOCUMENTS

| | | |
|---|---|---|
| JP | 11-329256 | 11/1999 |
| JP | 2002-063842 | 2/2002 |
| JP | 2003-506842 | 2/2003 |
| JP | 2003-272562 | 9/2003 |
| JP | 2004-178854 | 6/2004 |
| JP | 2004-288492 | 10/2004 |
| WO | 01/11644 | 2/2001 |

OTHER PUBLICATIONS

G. Oversluizen et al., 5.1: Invited Paper: High Efficacy PDP, Society for Information Display 03 Digest, 2003, pp. 28-31.

* cited by examiner

*Primary Examiner*—Karabi Guharay
*Assistant Examiner*—Brenitra M Lee
(74) *Attorney, Agent, or Firm*—Staas & Halsey LLP

(57) ABSTRACT

In accordance with an aspect of the present invention, a color display device (10) includes a plurality of gas discharge tubes disposed side by side. The gas discharge tubes have respective phosphor layers (4R, 4G, 4B) of different materials for different colors disposed therein and containing discharge gas therein. Each of the gas discharge tubes has a plurality of light-emitting points disposed along the length thereof. The color display device further includes a plurality of display electrodes disposed on the display screen side of the gas discharge tubes, and a plurality of signal electrodes (3) disposed on the rear side of the gas discharge tubes. Voltage control layers (6R, 6G, 6B) are disposed between the phosphor layers and the signal electrodes. The voltage control layers are made of materials which change firing voltages applied between the display electrodes and the signal electrodes. The materials of the voltage control layers are selected for the different materials of the different phosphor layers so as to minimize the difference of the firing voltages for the plurality of gas discharge tubes.

6 Claims, 6 Drawing Sheets

| MATERIAL OF VOLTAGE CONTROL LAYER | FIRING VOLTAGE FOR SURFACE DISCHARGE [V] | FIRING VOLTAGE FOR OPPOSITION DISCHARGE [V] |
|---|---|---|
| NOT APPLIED | 355 | 290 |
| Al | 360 | 280 |
| Cr | 361 | 278 |
| $TiO_2$ | 343 | 295 |
| MgO | 350 | 300 |

FIG. 8

COLOR DISPLAY DEVICE

CROSS REFERENCE TO RELATED APPLICATION

This application is a continuing application, filed under 35 U.S.C. §111(a), of International Application PCT/JP2005/005348, filed Mar. 24, 2005, the contents of which are incorporated herein by reference.

FIELD OF THE INVENTION

The present invention relates generally to a color display device having color phosphor layers, and, more particularly, to a color display device employing discharge-induced light-emission elements having phosphor layers of different materials.

BACKGROUND ART

A plasma tube array (PTA) and a plasma display panel (PDP) are known as a thin color display device employing discharge-induced light-emission elements. (See JP 2004-178854-A.)

G. Oversluizen et al. disclose, in "5.1 High Efficiency PDP", SID (Society for Information Display), 03 DIGEST, 2003, pp. 28-31, that the emission efficiency and luminosity of a PDP can be increased by providing a layer of titanium dioxide ($TiO_2$) under a phosphor layer of the PDP.

DISCLOSURE OF THE INVENTION

Discharge-induced light-emission elements having phosphor layers of different materials have a problem that discharge voltage characteristics differ for the different phosphor materials so that the drive margin for the elements becomes narrower. Particularly, the problem is that characteristics of discharge occurring through a phosphor layer between the electrodes greatly differ for the different phosphor materials. Hence, even when the voltage to be applied is the same for the different phosphor materials, the phosphor materials have different discharging conditions, so that the common drive margin becomes narrow.

Specifically, a plasma tube array, which is formed by arranging, side by side, a number of thin elongated gas discharge tubes (plasma tubes) of three types respectively having R, G and B phosphors formed therein, include longitudinally extending address electrodes contacting the outer walls of the tubes, and also include pairs of display electrodes extending transversely to the tubes provided on the outer wall surfaces of the tubes opposite to the address electrodes. Accordingly, the distance between the address electrodes and the display electrodes sandwiching the tubes is generally equal to the diameter of the tubes, which may be, for example, in the order of 500 μm. This dimension is significantly larger than the discharge gap between address and display electrodes of a common PDP of a three-electrode surface discharge type, and necessarily requires a higher voltage for the address discharge.

In a color PDP employing color phosphors, the properties of the surfaces of the R, G and B phosphors exposed to the gas discharge space differ from each other, which results in variations of discharge voltages for different emitted light colors described above. In a color display device of a plasma tube array type, in particular, the inner spaces of the respective discharge tubes are independent of each other, and hence there is no coupling between laterally adjacent cells, which is different from the coupling between laterally adjacent cells in the common PDP, so that the variations of the discharge voltages of the tubes due to the difference in phosphor materials tend to be more noticeable. Thus, because of the requirements of high addressing voltages for the tubes and the variations of the discharge voltages due to the different phosphor materials, a color display device of a plasma tube array type, in particular, requires a drive voltage margin to be large in absolute value, which should desirably be improved.

An object of the present invention is to correct variations of discharge voltage characteristics of different color phosphor materials of discharge light emission elements or of a display device including such discharge light emission elements.

Another object of the invention is to provide an increased drive margin for a display device having different phosphor layers.

SUMMARY OF THE INVENTION

In accordance with an aspect of the present invention, a color display device includes a plurality of gas discharge tubes disposed side by side. The gas discharge tubes have respective phosphor layers of different materials for different colors disposed therein and containing discharge gas therein. Each of the gas discharge tubes has a plurality of light-emitting points disposed along the length thereof. The color display device further includes a plurality of display electrodes disposed on the display screen side of the gas discharge tubes, and a plurality of signal electrodes disposed on the rear side of the gas discharge tubes. Voltage control layers are disposed between the phosphor layers and the signal electrodes. The voltage control layers are made of materials which change firing voltages applied between the display electrodes and the signal electrodes. The materials of the voltage control layers are selected for the different materials of the different phosphor layers so as to minimize the difference of the firing voltages for the plurality of gas discharge tubes.

In accordance with another aspect of the invention, a color display device includes: a plurality of light-emitting cells including phosphor layers of different materials for different colors and a discharge gas; a plurality of display electrodes disposed on the display screen side of the plurality of light-emitting cells; and a plurality of signal electrodes disposed on the rear side of the plurality of light-emitting cells. Voltage control layers are formed between the signal electrodes and the phosphor layers. The voltage control layers are made of materials which change firing voltages applied between the display electrodes and the signal electrodes, and the materials are selected for the different materials of the different phosphor layers so as to minimize the difference between the firing voltages for the plurality of light-emitting cells.

In accordance with a further aspect of the invention, in the color display device, a first voltage control layer is formed between each of first ones of the plurality of light emitting cells that emit a first color light and a corresponding one of the signal electrodes, and a second voltage control layer is formed between each of second ones of the plurality of light emitting cells that emit a second color light and a corresponding one of the signal electrodes. The first voltage control layer is made of a material which increases a firing voltage applied between the display electrodes and the signal electrodes of the first light emitting cells. The second voltage control layer is made of a material which decreases a firing voltage applied between the display electrodes and the signal electrodes of the second light emitting cells, whereby the difference between the firing voltages for the first and second light emitting cells is minimized.

According to the invention, in a display device having different color phosphor materials, the variations of discharge voltage characteristics of different color phosphor materials can be corrected, and the drive margin can be increased. In particular, the invention can be advantageously applied to a color display device of a plasma array tube type with independent discharge spaces for different colors, for narrowing differences of the discharge voltages for different color tubes and increasing the drive margin.

BRIEF DESCRIPTION OF THE DRAWINGS

FIG. 8 shows a table of comparison of the firing voltages for surface and opposite discharges for different materials of the voltage control layers of the gas discharge tubes.

DESCRIPTION OF THE PREFERRED EMBODIMENTS

The invention will be described with reference to the accompanying drawings. Throughout the drawings, similar symbols and numerals indicate similar items and functions.

Figure 1:
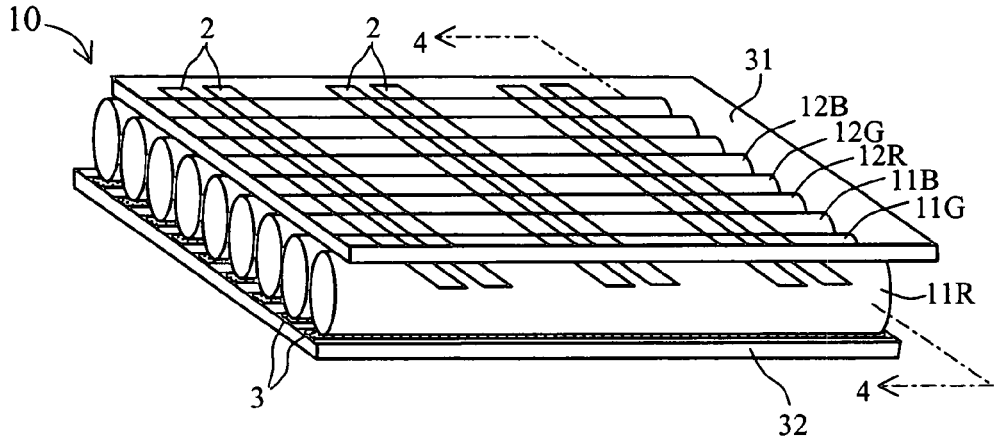
FIG. 1 shows an example of the structure of part of a large display device of a plasma tube array type, in accordance with an embodiment of the present invention.

FIG. 1 shows an example of the structure of part of a large display device 10 of a plasma tube array type, in accordance with an embodiment of the present invention. In FIG. 1, the display device 10 includes a plurality of transparent, thin elongated gas discharge tubes 11R, 11G, 11B, 12R, 12G, 12B, . . . , disposed in parallel, a front support sheet 31 comprised of a transparent, front support sheet or thin plate, a rear support 32 comprised of a transparent or opaque, rear support sheet or thin base plate, a plurality of pairs of display electrodes or main electrodes 2, and a plurality of signal or data electrodes 3. Letters R, G and B represent red, green and blue, which are colors of light emitted by the phosphors. The support plate 31 and 32 are made of a resilient or flexible PET film, glass sheet or any other suitable material. In order to improve contrast in display, the rear plate 32 is black or dark. Alternatively, a separate black or dark sheet may be bonded to the rear or front surface of the rear plate 32.

Typically, phosphor support members having respective red, green and blue (R, G, B) phosphor layers formed or deposited thereon are inserted into the interior discharge spaces of the thin elongated gas discharge tubes 11R, 11G, 11B, 12R, 12G, 12B, . . . , respectively. Discharge gas including neon (Ne) gas and xenon (Xe) gas is introduced into the interior discharge space of each gas discharge tube, and the gas discharge tube is sealed at its opposite ends. The support members may have a U-shaped or C-shaped cross section perpendicular to the length of the support members. Alternatively, the phosphor layer may be formed or deposited on the inner surface of an associated gas discharge tube without using the support member. The signal electrodes 3 are formed on the rear support sheet 32 and extend along the longitudinal direction of the respective discharge tubes 11R, 11G, 11B, . . . . The pairs of display electrodes 2 are formed on the front support sheet 31 and extend in the direction crossing the signal electrodes 3. A distance providing a non-discharging region or non-discharging gap is provided between each pair of display electrodes 2 and an adjacent pair of display electrodes 2.

The signal electrodes 3 and the pairs of display electrodes 2 are brought into intimately contact respectively with the lower and upper peripheral surfaces of the gas discharge tubes 11R, 11G, 11B, . . . , when the display device 10 is assembled. In order to provide better contact, an electrically conductive adhesive may be placed between the display electrodes and the gas discharge tubes.

In plan view of the display device 10 seen from the front side, the intersections of the signal electrodes 3 and the pairs of display electrodes 2 provide unit light-emitting regions. Display is provided by using either one electrode of each pair of display electrodes 2 as a scanning electrode, generating a selection discharge at the intersection of the scanning electrode with the signal electrode 3 to thereby select a light-emitting region, and generating a display discharge between the pair of display electrodes 2 using the wall charge formed by the selection discharge on the region of the inner tube surface at the selected region, which, in turn, causes the associated phosphor layer to emit light. The selection discharge is an opposite or opposed discharge generated within each gas discharge tube 11R, 11G, 11B, . . . between the vertically opposed scan electrode 2 and signal electrode 3. The display discharge is a surface discharge generated within each gas discharge tube 11R, 11G, 11B, . . . between the two display electrodes of each pair of display electrodes disposed in parallel in a plane.

With the above-described arrangement of the display device 10 with a number of such gas discharge tubes 11R, 11G, 11B, . . . , arranged side by side, the display electrodes and the signal electrodes may be formed beforehand in the shape of dot and stripe, respectively, on the outer surfaces of the gas discharge tubes 11R, 11G, 11B, . . . , by printing, vapor deposition or any appropriate techniques, and power supply electrodes are formed on the front support sheet 31 and rear support sheet 32. When the display device 10 is assembled, the power supply electrodes are brought into contact with the display electrodes 2 and the signal electrodes 3 of the gas discharge tubes 11R, 11G, 11B, . . . .

Figure 2:
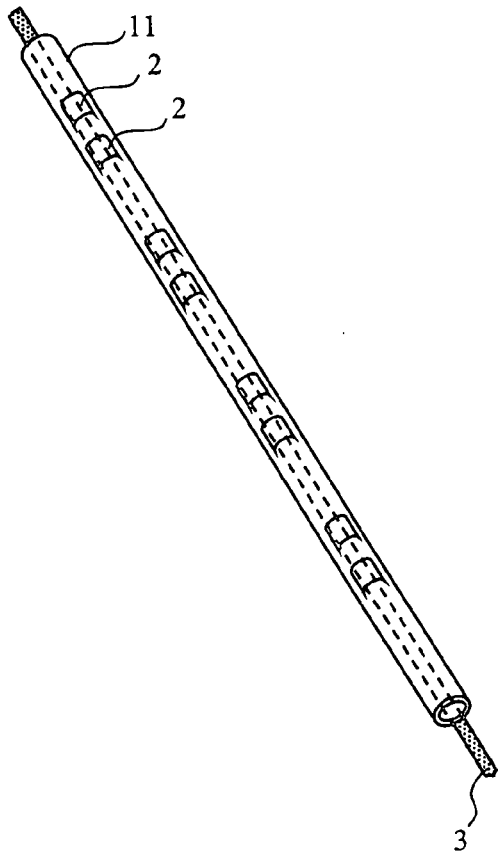
FIG. 2 shows an example of a gas discharge tube with pairs of dot-shaped display electrodes and a stripe-shaped signal electrode, which are formed on the tube surface.

FIG. 2 shows an example of a gas discharge tube 11 with pairs of dot-shaped display electrodes 2 and a stripe-shaped signal electrode 3, which are formed on the tube surface.

Figure 3:
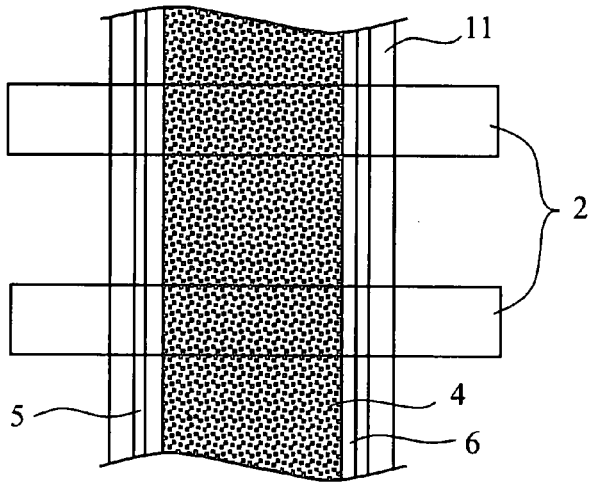
FIG. 3 is a partial enlarged plan view of the gas discharge tube in the vicinity of the pair of display electrodes.

FIG. 3 is a partial enlarged plan view of the gas discharge tube 11 in the vicinity of the pair of display electrodes 2. In FIG. 3, an electron emissive film 5 of MgO is formed on the inner surface of the gas discharge tube 11, and a support member 6 with a phosphor layer 4 formed thereon is disposed within the gas discharge tube 11.

As described above, the gas discharge tube 11 is arranged such that the phosphor layer 4 is caused to emit light through discharge by the plurality of pairs of display electrodes 2 disposed in contact with the tube outer wall surface, whereby a number of light-emitting points (display portions) can be provided in the single tube. The gas discharge tube 11 is formed of a transparent insulating material, e.g. borosilicate glass, and, typically, has a tube diameter of 2 mm or smaller and a tube length of 300 mm or larger.

Figure 4:
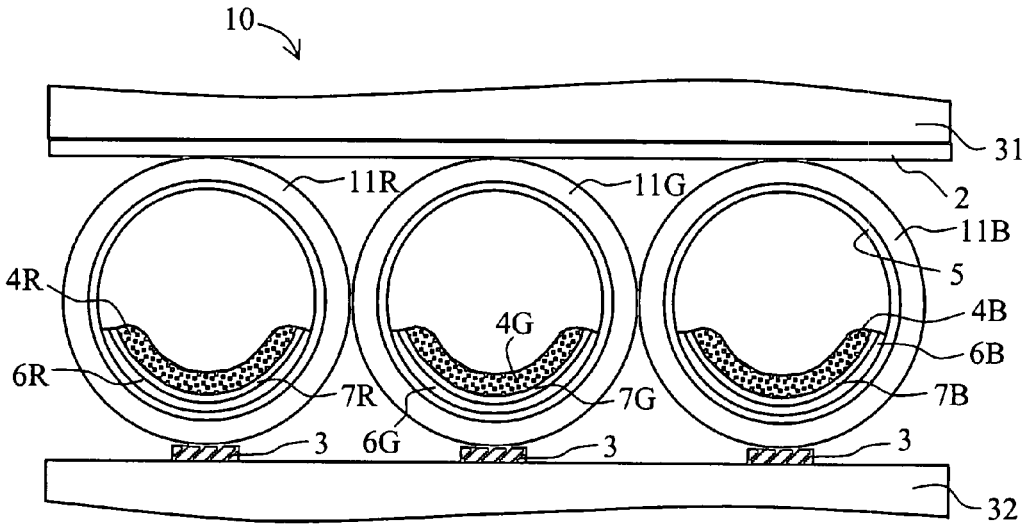
FIG. 4 is a cross-sectional view of the gas discharge tube along a line 4-4 in FIG. 1.

FIG. 4 is a cross-sectional view of the gas discharge tubes 11R, 11G and 11B along a line 4-4 in FIG. 1.

Support members 6R, 6G and 6B are made of a transparent insulating material, e.g. borosilicate glass, and are members separate from tubular envelopes (glass tubes) of the gas discharge tubes 11R, 11G and 11B. Voltage control layers 7R, 7G and 7B are formed over the support members 6R, 6G and 6B, respectively, and corresponding phosphor layers 4R, 4G and 4B are formed over the voltage control layers 7R, 7G and 7B, respectively.

The voltage control layers 7R and 7B of gas discharge tubes having red-emitting and blue-emitting phosphors may contain a metal, such as aluminum (Al), chromium (Cr), copper (Cu) or silver (Ag), and have a thickness of from about 1 μm to about 10 μm. The voltage control layer 7G of a gas discharge tube having a green-emitting phosphor may contain a metal oxide of a metal of Group I or Group II, or other suitable material, for example, titanium oxide ($TiO_2$), magnesium oxide (MgO), calcium oxide (CaO), barium oxide (BaO) or potassium oxide (KO), and has a thickness of from about 10 μm to about 20 μm.

Typically, the thickness of the phosphor materials of phosphor layers R, G, B is of a value in a range of from about 30 μm to about 50 μm. As phosphor pastes, different ones known in the technical field can be used. For example, the red-emitting phosphor 4R may be of an yttrium type ($Y_2O_3$:Eu), the green-emitting phosphor 4G may be of a zinc silicate type ($Zn_2SiO_4$:Mn), and the blue-emitting phosphor 4B may be of a BAM type ($BaMgAl_{10}O_{17}$).

The voltage control layers 7R, 7G and 7B are formed on the support members 6R, 6G and 6B, respectively, outside the glass tubes, by printing, vapor deposition or sputtering, and, after that, color phosphor pastes corresponding to the respective voltage control layers 7R, 7G and 7B are applied over the voltage control layers 7R, 7G and 7B and, then, baked, to thereby form the phosphor layers 4R, 4G and 4B on the support members 6R, 6G and 6B, respectively. After that, the support members 6R, 6G and 6B are inserted into and positioned in place in the glass tubes.

The pair of display electrodes 2 and the signal electrode 3 are capable of generating a discharge through the discharge gas within the tube upon application of a voltage between them. In FIGS. 2 through 4, the electrode structure of the gas discharge tubes 11R, 11G and 11B is such that three electrodes are disposed for one light emitting part or cell, in which the pair of display electrodes produces a display discharge. However, it is not limited to such structure, but an electrode structure in which a display discharge is generated between the display electrode 2 and the signal electrode 3, may be employed. Specifically, a single display electrode is used in place of the pair of display electrodes 2, and the single display electrode 2 is used as a scan electrode to produce a selection discharge and a display discharge (opposite discharge) between the display electrode 2 and the signal electrode 3.

The electron emissive film 5 emits electrons when bombarded with ions in the discharge gas. When a voltage is applied to the pair of display electrodes 2, the discharge gas hermetically enclosed in the tube is excited, and, the phosphor layer 4 emits visible light by virtue of vacuum ultraviolet light generated in the deexcitation process of the excited rare gas atoms.

Figure 5:
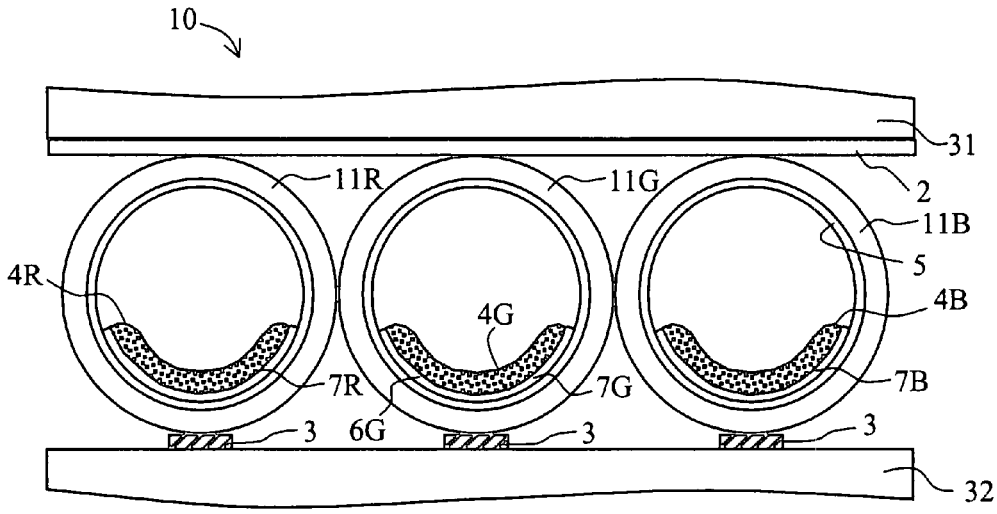
FIG. 5 shows a modification of the structure of the discharge tubes shown in FIG. 4, and is a cross-sectional view along the line 4-4 in FIG. 1, in which the phosphor layers are formed on the inner surface portions of the gas discharge tubes, respectively, without using support members.

FIG. 5 shows a modification of the structure of the discharge tubes shown in FIG. 4, and is a cross-sectional view along the line 4-4 in FIG. 1, in which the phosphor layers 4R, 4G and 4B are formed on the inner surface portions of the gas discharge tubes 11R, 11G and 11B, respectively, without using support members. An electron emissive layer 5 is formed on the inner surface of each of the gas discharge tubes 11R, 11G and 11B, with the voltage control layer 7R, 7G or 7B formed on the associated electron emissive layer 5 at the bottom, and the phosphor layer 4R, 4G or 4B is formed on the associated voltage control layer 7R, 7G or 7B.

The invention is also applicable to a PDP. In such application, the voltage control layers may be formed beneath the phosphor layers of the PDP or between the phosphor layers and the dielectric layer.

Figure 6A:
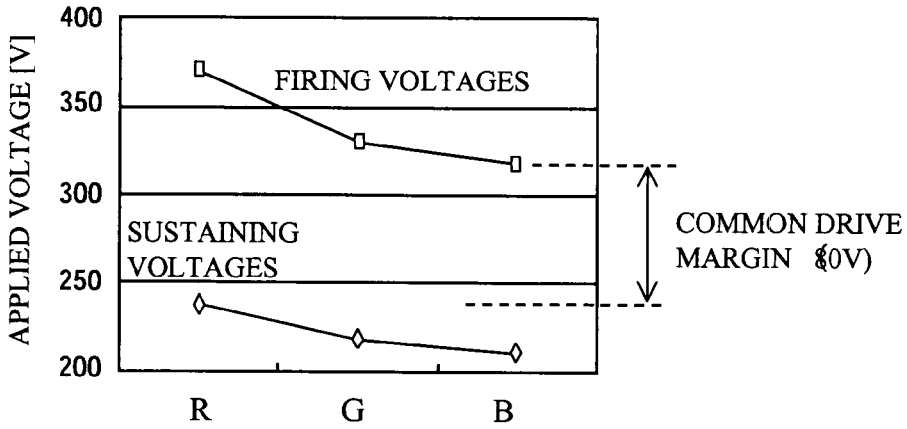
FIG. 6A shows firing and sustaining voltages for initiating and sustaining surface discharge between display electrodes of prior art gas discharge tubes.
Figure 6B:
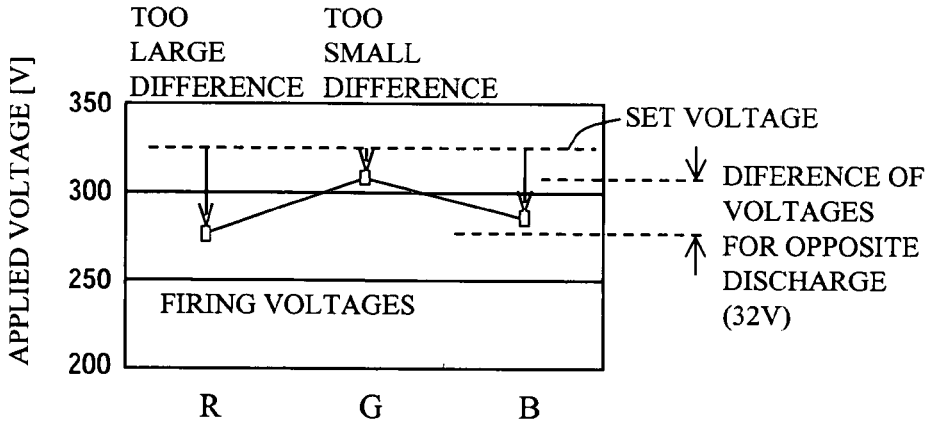
FIG. 6B shows a firing voltage for initiating opposite discharge between a display electrode and a signal electrode of the prior art gas discharge tubes.

FIG. 6A shows firing and sustaining voltages for initiating and sustaining surface discharge between display electrodes of prior art gas discharge tubes 11R, 11G and 11B, each tube having a wall thickness of 80 μm and an outer diameter of 500 μm. FIG. 6B shows a firing voltage for initiating opposite discharge between a display electrode and a signal electrode of the prior art gas discharge tubes.

As is seen from FIG. 6A, due to different properties of different color emitting phosphor materials, the firing and sustaining voltages for surface discharge of the red-emitting gas discharge tube 11R are the highest of the three, the firing and sustaining voltages for surface discharge of the blue-emitting gas discharge tube 11B are the lowest of the three, and the firing and sustaining voltages for surface discharge of the green-emitting gas discharge tube 11G are intermediate and are nearer to those of the blue-emitting gas discharge tube 11B. The common drive margin of such a display device is dependent on the difference between the lowest one of the firing voltages for the surface discharge and the highest one of the sustaining voltages for the surface discharge, and is, for example, 80 V. It is desirable to provide a larger common drive margin. As the pressure of the discharge gas in a gas discharge tube is higher, the common drive margin between the firing voltages and the sustaining voltages for surface discharge tends to be smaller.

As is seen from FIG. 6B, due to the different properties of the different color emitting phosphor materials, the firing voltage for opposite discharge of the red-emitting gas discharge tube 11R is the lowest of the three, the firing voltage for opposite discharge of the green-emitting gas discharge tube 11G is the highest of the three, and the firing voltage for opposite discharge of the blue-emitting gas discharge tube 11B is intermediate and nearer to that of the red-emitting gas discharge tube 11R. It is desirable that the difference of the firing voltages for opposite discharge among the gas discharge tubes 11R, 11G and 11B be small. Conventionally, the difference between the highest and lowest firing voltages for opposite discharge of the gas discharge tubes 11R, 11G and 11B is such as not to be negligible, and is 32 V for example. Thus, when the difference between the firing voltage for opposite discharge and the preset value of voltage to be applied is too large, an excessive discharge tends to be generated, sometimes causing an erasing discharge to occur, which, in turn, decreases the wall charge so that light cannot be emitted. On the other hand, when the difference between the firing voltage and the preset value of voltage to be applied is too small, an insufficient discharge tends to occur, resulting in insufficient wall charge and causing no light to be emitted.

Figure 7A:
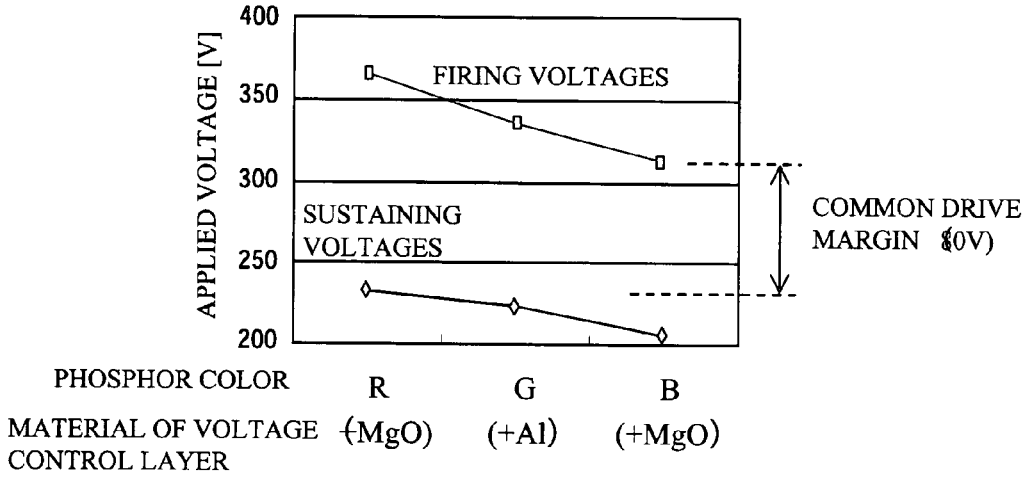
FIGS. 7A and 7B show the firing and sustaining voltages for initiating and sustaining surface discharge and the firing voltage for initiating opposite discharge, respectively, of the gas discharge tubes, in accordance with the embodiment of the invention.
Figure 7B:
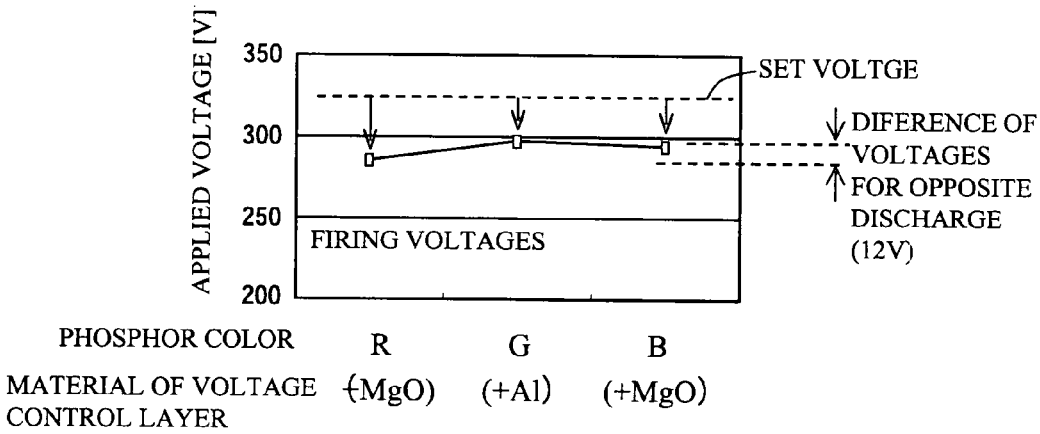

FIGS. 7A and 7B show the firing and sustaining voltages for initiating and sustaining surface discharge and the firing voltage for initiating opposite discharge, respectively, of the gas discharge tubes 11R, 11G and 11B, in accordance with the embodiment of the invention. The voltage control layers of the gas discharge tubes 11R, 11G and 11B are made of magnesium oxide, aluminum and magnesium oxide, respectively.

As is seen in FIG. 7A, in comparison with the firing voltage for surface discharge of the prior art gas discharge tubes shown in FIG. 6A, the firing voltage for surface discharge of the gas discharge tube 11R is slightly lower by virtue of the presence of the voltage control layer 7R, the firing voltage for surface discharge of the gas discharge tube 11G is slightly higher by virtue of the presence of the voltage control layer 7G, and the firing voltage for surface discharge of the gas discharge tube 11B is slightly lower by virtue of the presence of the voltage control layer 7B. The common drive margin between the firing voltages and the sustaining voltages for surface discharge is slightly smaller but almost the same.

As is seen from FIG. 7B, in comparison with the firing voltage for opposite discharge of the prior art gas discharge tube shown in FIG. 6B, the presence of the voltage control layer 7R increases the firing voltage for opposite discharge of the gas discharge tube 11R, the presence of the voltage control layer 7G decreases the firing voltage for opposite discharge of the gas discharge tube 11G, and the presence of the voltage control layer 7B increases the firing voltage for opposite discharge of the gas discharge tube 11B.

As is seen from FIG. 7B, the difference between the firing voltages for opposite discharge of the gas discharge tubes 11R, 11G and 11B is smaller, and is, for example, 12 V, which is smaller by as much as 20 V than the firing voltages for opposite discharge of the prior art gas discharge tubes. Thus, in the gas discharge tubes 11R, 11G and 11B in accordance with the embodiment of the invention, the differences of the firing voltages from the preset values of the voltages to be applied are generally equal, and no excessive or insufficient discharge occurs, so that proper discharges for emitting different light colors can be generated in the gas discharge tubes for all of the different colors.

FIG. 8 shows a table of comparison of the firing voltages for surface and opposite discharges for different materials of the voltage control layers of the gas discharge tubes 11. It is seen that the firing voltage for opposite discharge of the gas discharge tubes decreases by 10 V and 12 V when aluminum (Al) and chromium (Cr) are used for the voltage control layers, respectively, and increases by 5 V and 10 V when titanium oxide (TiO2) and magnesium oxide (MgO) are used, respectively.

The embodiment described above uses the voltage control layers for the phosphor layers for all of the colors, R, G and B. However, the voltage control layer may be provided only for a particular color phosphor layer.

The above-described embodiments are only typical examples, and their combination, modifications and variations are apparent to those skilled in the art. It should be noted that those skilled in the art can make various modifications to the above-described embodiments including application to a common color plasma display panel of a three-electrode surface discharge type, without departing from the principle of the invention and the accompanying claims.

What is claimed is:

1. A color display device comprising: a plurality of gas discharge tubes disposed side by side, said gas discharge tubes having respective phosphor layers of different materials for different colors disposed therein and containing discharge gas therein, said gas discharge tubes each having a plurality of light-emitting points disposed along the length thereof; a plurality of display electrodes disposed on the display screen side of said gas discharge tubes; and a plurality of signal electrodes disposed on the rear side of said gas discharge tubes, wherein voltage control layers are disposed between said phosphor layers and said signal electrodes, said voltage control layers are made of materials which change firing voltages applied between said display electrodes and said signal electrodes, and the materials of said voltage control layers are selected for the different materials of said different phosphor layers so as to minimize the difference between the firing voltages for said plurality of gas discharge tubes.

2. The color display device according to claim 1, wherein said phosphor layers and said voltage control layers are formed on support members separate from said gas discharge tubes, said support members being inserted into said gas discharge tubes and placed in discharge spaces of said gas discharge tubes.

3. A color display device comprising: a plurality of light-emitting cells including phosphor layers of different materials for different colors and a discharge gas; a plurality of display electrodes disposed on the display screen side of said plurality of light-emitting cells; and a plurality of signal electrodes disposed on the rear side of said plurality of light-emitting cells, wherein voltage control layers are formed between said signal electrodes and said phosphor layers, said voltage control layers are made of materials which change firing voltages applied between said display electrodes and said signal electrodes, and the materials of said voltage control layers are selected for the different materials of said different phosphor layers so as to minimize the difference between the firing voltages for said plurality of light-emitting cells.

4. The display device according to claim 3 wherein said voltage control layers contain an oxide of a metal of Group I or Group II.

5. The display device according to claim 3 wherein said voltage control layers contain a metal.

6. A color display device comprising: a plurality of light-emitting cells including phosphor layers of different materials for different colors and a discharge gas; a plurality of display electrodes disposed on the display screen side of said plurality of light-emitting cells; and a plurality of signal electrodes disposed on the rear side of said plurality of light-emitting cells, wherein a first voltage control layer is formed between each of first ones of said plurality of light emitting cells that emit a first color light and a corresponding one of said signal electrodes, a second voltage control layer is formed between each of second ones of said plurality of light emitting cells that emit a second color light and a corresponding one of said signal electrodes, wherein said first voltage control layer is made of a material which increases a firing voltage applied between the display electrodes and the signal electrodes of said first light emitting cells, said second voltage control layer being made of a material which decreases a firing voltage applied between the display electrodes and the signal electrodes of said second light emitting cells, whereby the difference between the firing voltages for said first and second light emitting cells is minimized.

* * * * *